US011509050B2

(12) United States Patent
Tae et al.

(10) Patent No.: US 11,509,050 B2
(45) Date of Patent: Nov. 22, 2022

(54) MULTI-BAY ANTENNA APPARATUS AND ITS OPERATION METHOD

(71) Applicant: Electronics and Telecommunications Research Institute, Daejeon (KR)

(72) Inventors: Ki Cheol Tae, Daejeon (KR); Kanghee Kim, Daejeon (KR); Haeng Sook Ro, Daejeon (KR); Gwangmoon Park, Daejeon (KR); Soo-Ho Sohn, Daejeon (KR); Ho Jin Lee, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 99 days.

(21) Appl. No.: 16/837,728

(22) Filed: Apr. 1, 2020

(65) Prior Publication Data

US 2020/0365986 A1 Nov. 19, 2020

(30) Foreign Application Priority Data

May 17, 2019 (KR) ..... 10-2019-0058028
Dec. 10, 2019 (KR) ..... 10-2019-0163681

(51) Int. Cl.
*H01Q 3/12* (2006.01)
*H01Q 1/10* (2006.01)
*H01Q 1/24* (2006.01)

(52) U.S. Cl.
CPC ..... *H01Q 3/12* (2013.01); *H01Q 1/10* (2013.01); *H01Q 1/246* (2013.01)

(58) Field of Classification Search
CPC ..... H01Q 1/10; H01Q 1/1235; H01Q 1/246; H01Q 1/521; H01Q 5/42
See application file for complete search history.

(56) References Cited

U.S. PATENT DOCUMENTS

| | | | | |
|---|---|---|---|---|
| 9,710,576 | B2 | 7/2017 | Payne | |
| 10,044,112 | B2 | 8/2018 | Park et al. | |
| 10,193,220 | B2 | 1/2019 | Lee et al. | |
| 2015/0214599 | A1* | 7/2015 | Kawahara | H01Q 21/20 343/879 |
| 2015/0372379 | A1* | 12/2015 | Zhao | H01Q 1/1242 343/841 |
| 2020/0021354 | A1* | 1/2020 | Ashworth | H01Q 1/3283 |

FOREIGN PATENT DOCUMENTS

| | | | |
|---|---|---|---|
| CN | 108879065 | A | 11/2018 |
| KR | 1020040078551 | A | 9/2004 |
| KR | 1020140109708 | A | 9/2014 |
| KR | 1020170058110 | A | 5/2017 |
| KR | 101879404 | B1 | 7/2018 |

* cited by examiner

*Primary Examiner* — Daniel Munoz
(74) *Attorney, Agent, or Firm* — William Park & Associates Ltd.

(57) ABSTRACT

There are provided a multi-bay antenna apparatus and an operation method thereof. A multi-bay antenna apparatus may include a first section, a first array antenna mounted in the first section to receive a signal in a predetermined frequency band, a second section movably coupled with the first section, and a second array antenna mounted in the second section to receive a signal in a predetermined frequency band.

7 Claims, 7 Drawing Sheets

<Case 1>

<Case 2>

<Case 1>

<Case 2>

MULTI-BAY ANTENNA APPARATUS AND ITS OPERATION METHOD

CROSS-REFERENCE TO RELATED APPLICATION(S)

This application claims the benefit of Korean Patent Application No. 10-2019-0058028 filed on May 17, 2019, and Korean Patent Application No. 10-2019-0163681 filed on Dec. 10, 2019, in the Korean Intellectual Property Office, the entire disclosures of which are incorporated herein by reference for all purposes.

BACKGROUND

1. Field of the Invention

Example embodiments relate to a multi-bay antenna apparatus and an operation method, and more particularly, an apparatus and a method that minimize interference between antenna elements in a multi-bay antenna apparatus.

2. Description of the Related Art

A multi-bay antenna is an antenna apparatus that receives a wide frequency band by arranging antennas or an antenna array of different bays for each frequency band. At this time, the interval for each antenna bay of the multi-bay antenna is associated with the total height of the moving vehicle system; vehicle driving stability may be achieved by minimizing the interval.

When the height of the multi-bay antenna increases in a state where the height of the moving vehicle system is set to the same height, the antenna mast needs to be shorter; to provide the same rise height, the system needs to be implemented by increasing the section number of the antenna mast. As such, the fixed antenna array with a narrow bay interval in the multi-bay antenna may affect antenna elements; as compared with the performance obtained by measuring only a single-layer antenna, equal performance may not be secured.

Accordingly, a method is requested to minimize the interference between antennas in a multi-bay antenna.

SUMMARY

An aspect provides an antenna apparatus and an operation method that adaptively control the interval with another array antenna by adding a section in which an array antenna receiving a signal in the corresponding frequency band are coupled with the corresponding array antenna, depending on the number of frequency bands to be received.

Another aspect also provides an antenna apparatus and an operation method that minimize the interference between array elements to improve reception performance, by minimizing the antenna height when moving to increase stability and by maximizing an antenna height when measuring a signal to extend the interval between antennas for each band.

According to an aspect, there is provided a multi-bay antenna apparatus including a first section, a first array antenna mounted in the first section to receive a signal in a predetermined frequency band, a second section movably coupled with the first section, and a second array antenna mounted in the second section to receive a signal in a predetermined frequency band.

According to an aspect, the first section may move to a distance where a signal received by the first array antenna and a signal received by the second array antenna do not interfere with each other such that the first array antenna and the second array antenna are spaced.

According to an aspect, the second array antenna and the first array antenna may receive signals in different frequency bands from each other.

According to an aspect, the second array antenna and the first array antenna receive signals in the same frequency band as each other, and the first section may move to a location to allow the first array antenna and the second array antenna to be arranged to be spatially distributed to increase an interval between the first array antenna and the second array antenna.

According to an aspect, the multi-bay antenna apparatus may further include a third section and a third array antenna mounted in the third section to receive a signal in a predetermined frequency band. The second section may be movably coupled with the third section.

According to an aspect, the second section of the multi-bay antenna apparatus may move such that an interval between the second array antenna and the third array antenna is spaced, after the first section moves to a predetermined distance.

According to an aspect, there is provided a multi-bay antenna apparatus coupled with a movable apparatus including a first section, a first array antenna mounted in the first section to receive a signal in a predetermined frequency band, a second array antenna to receive a signal in a predetermined frequency band, a second section, an actuator to move the first section, and a sensor to measure whether the movable apparatus is moved and a moving speed of the movable apparatus. The second section may be internally coupled with the first section and externally coupled with the second array antenna.

According to an aspect, the actuator of the multi-bay antenna apparatus coupled with a movable apparatus may move the first section such that an interval between the first array antenna and the second array antenna is minimized, when it is measured by the sensor that the movable apparatus is moving at a predetermined speed or more.

According to an aspect, the actuator of the multi-bay antenna apparatus coupled with a movable apparatus may move the first section to a distance where a signal received by the first array antenna and a signal received by the second array antenna do not interfere with each other such that the first array antenna and the second array antenna are spaced, when it is measured by the sensor that the movable apparatus is moving at less than a predetermined speed.

According to an aspect, there is provided a signal measuring method performed by a multi-bay antenna apparatus coupled with a movable apparatus including measuring whether the movable apparatus is moved and a moving speed of the movable apparatus, determining whether an antenna is moving, based on whether the movable apparatus is moved and the moving speed of the movable apparatus, when the antenna is moving, decreasing an interval between a first array antenna and a second array antenna, and increasing the interval between the first array antenna and the second array antenna when the antenna is not moving or is measuring a signal.

According to an aspect, the multi-bay antenna of the signal measuring method performed by the multi-bay antenna apparatus coupled with a movable apparatus may include a first section, the first array antenna mounted in the first section to receive a signal in a predetermined frequency band, the second array antenna to receive a signal in a predetermined frequency band, a second section, and an actuator to move the first section. The first section may be internally coupled with the second section and the second array antenna may be externally coupled with the second section.

According to an aspect, the decreasing of the interval of the signal measuring method performed by the multi-bay antenna apparatus coupled with a movable apparatus may include moving, by the actuator, the first section such that the interval between the first array antenna and the second array antenna is minimized and the first array antenna may be mounted in the first section.

According to an aspect, the increasing of the interval of the signal measuring method performed by the multi-bay antenna apparatus coupled with a movable apparatus may include moving, by the actuator, the first section to a distance where a signal received by the first array antenna and a signal received by the second array antenna do not interfere with each other such that the first array antenna and the second array antenna are spaced.

BRIEF DESCRIPTION OF THE DRAWINGS

These and/or other aspects, features, and advantages of the invention will become apparent and more readily appreciated from the following description of example embodiments, taken in conjunction with the accompanying drawings of which.

DETAILED DESCRIPTION

Figure 1:
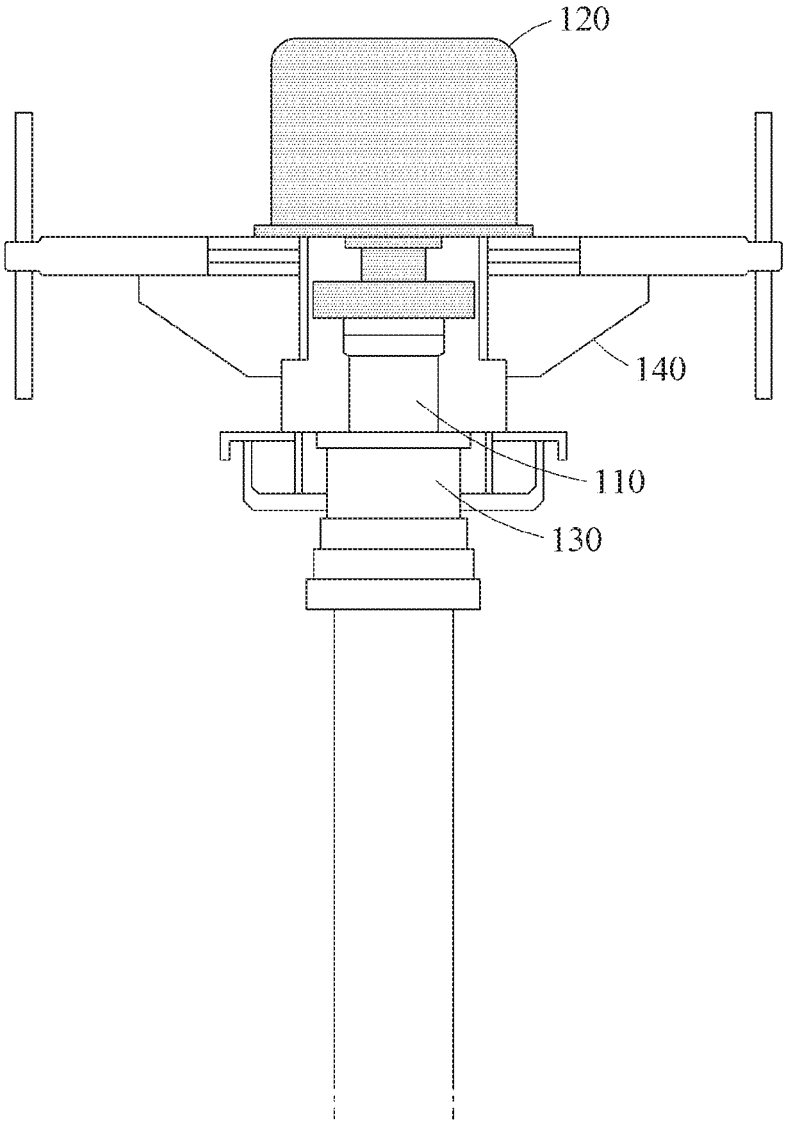
FIG. 1 is a view illustrating a multi-bay antenna apparatus, according to a first example embodiment of the present invention.

Hereinafter, example embodiments of the present invention will be described in detail with reference to accompanying drawings. Various changes may be made to the example embodiments, but the scope of the present invention is neither limited nor restricted by the example embodiments. It should be understood that all modifications, equivalents, and alternatives for the example embodiments are included in the spirit and scope of the present invention.

The terminology used in the example embodiment is for the purpose of description and should not be construed as limiting. The articles "a," "an," and "the" are singular in that they have a single referent, however, the use of the singular form in the present document should not preclude the presence of more than one referent. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Furthermore, in the following description with reference to the accompanying drawings, the same reference numerals are assigned to the same components regardless of the reference numerals, and redundant descriptions thereof will be omitted. In the following description of the example embodiment, when it is determined that the detailed description of the related well-known technology may obscure the gist of the example embodiment unnecessarily, the detailed description thereof will be omitted.

Hereinafter, a description will be given in detail for example embodiments of the present invention with reference to the following drawings.

FIG. 1 is a view illustrating a multi-bay antenna apparatus, according to a first example embodiment of the present invention.

As illustrated in FIG. 1, a multi-bay antenna apparatus may include a first section 110, a first array antenna 120, a second section 130, and a second array antenna 140.

As illustrated in FIG. 1, the first section 110 may be a section in which the first array antenna is mounted.

The first array antenna 120 receives a signal in a predetermined frequency band and may be mounted on the top surface or side surface of the first section 110. For example, as illustrated in FIG. 1, the first array antenna 120 may be an antenna in a shape in which a high-band array antenna is surrounded with radome. At this time, the radome of the first array antenna 120 may be removed according to an example embodiment. Furthermore, the first array antenna 120 may be two or more fixed interval antenna bays, according to an example embodiment.

Moreover, the first array antenna 120 and the second array antenna 140 may receive signals in frequency bands different from each other. At this time, the first section 110 may allow the first array antenna and the second array antenna to be spaced from each other by moving to a distance at which the signal received by the first array antenna and the signal received by the second array antenna does not interfere with each other.

Also, the first array antenna 120 and the second array antenna 140 may receive signals in the same frequency band as each other. At this time, the first section 110 may increase an interval between the first array antenna 120 and the second array antenna 140 by moving to a location that allows the first array antenna 120 and the second array antenna 140 to be arranged to be spatially distributed.

Furthermore, the number of array antennas and the number of sections included in the multi-bay antenna apparatus may be three or more. For example, the multi-bay antenna apparatus may further include a third section in which the second section 130 is coupled movably and a third array antenna mounted in the third section to receive a signal in a predetermined frequency band.

Moreover, after the first section 110 moves to a predetermined distance, the second section 130 may move such that the interval between the second array antenna 140 and the third array antenna is spaced. Furthermore, the second section 130 may move together at the same rate or at the predetermined rate, in conjunction with the movement of the first section 110. At this time, the multi-bay antenna apparatus may receive signals in three different frequency bands.

Furthermore, the first section 110 and the second section 130 may include brackets of different lengths for separately mounting the first array antenna 120 and the second array antenna 140 and for securing the space for controlling a length, respectively.

Furthermore, the cabling between array antennas in a multi-bay antenna apparatus may be installed at a length corresponding to the change in interval between array antennas depending on the movement of sections. Furthermore, the collection part of the cable in a multi-bay antenna apparatus may be installed in the bay of all band antennas. Furthermore, according to an example embodiment, the total number of antenna cables coming down through the mast may be reduced by installing the antenna bay and channel selecting and filtering part in the cable collection part of the multi-bay antenna apparatus.

That is, the multi-bay antenna apparatus may adaptively control the interval with another array antenna by adding a section in which an array antenna receiving a signal in the corresponding frequency band are coupled with the corresponding array antenna, depending on the number of frequency bands to be received, thereby receiving signals in multiple different frequency bands.

Figure 2:
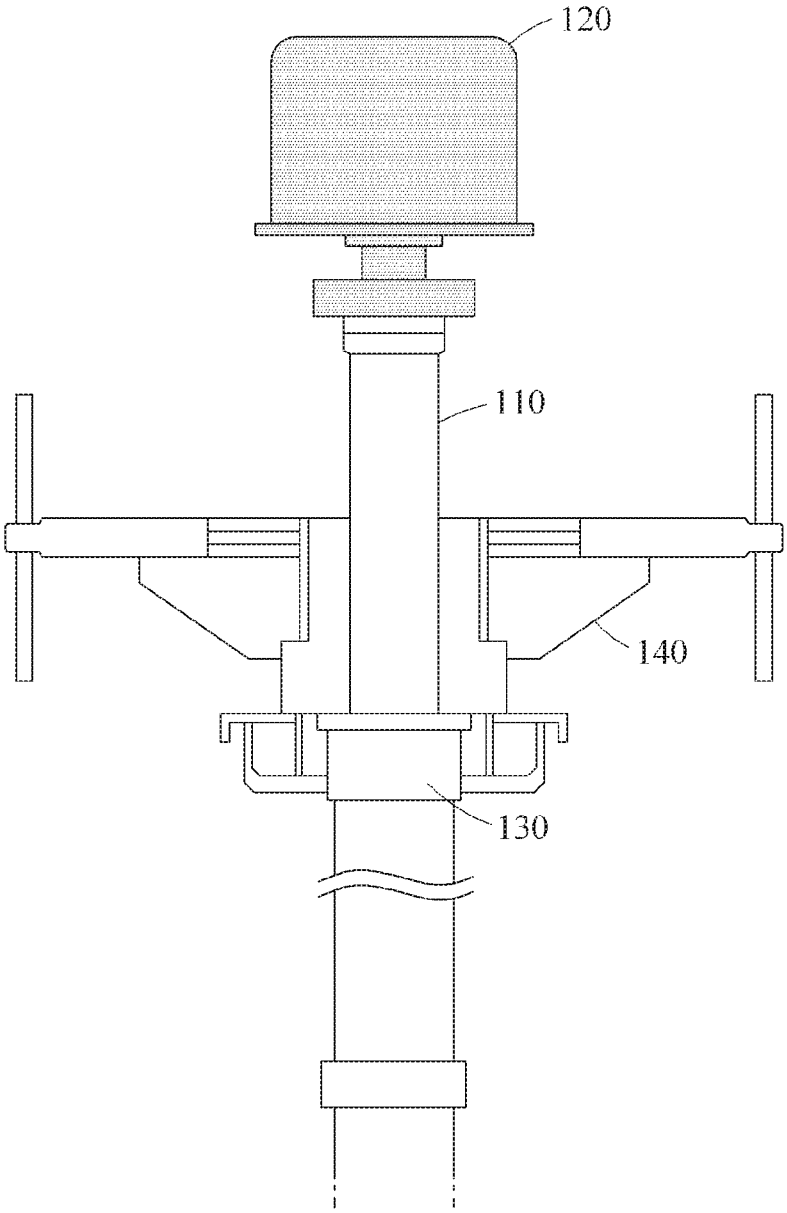
FIG. 2 is a view illustrating an operation of a multi-bay antenna apparatus, according to a first example embodiment of the present invention.

FIG. 2 is a view illustrating an operation of a multi-bay antenna apparatus, according to a first example embodiment of the present invention.

In FIG. 1, the first section 110 of a multi-bay antenna apparatus is in a state where the first section 110 is maximally inserted into the second section 130 such that the interval between the first array antenna 120 and the second array antenna 140 is minimized. Moreover, as illustrated in FIG. 2, the first section 110 of a multi-bay antenna apparatus may move the first array antenna 120 away from the second array antenna 140 by moving upward with respect to the multi-bay antenna apparatus.

At this time, when rising to the maximum height, the antenna mast of the multi-bay antenna apparatus including the first section 110 and the second section 130 may rise sequentially from the first section 110, or the interval between sections may increase at a specific rate while the entire mast rises together.

When each of the sections in the antenna mast of the multi-bay antenna apparatus rises sequentially from the first section 110, the multi-bay antenna apparatus may measure signals, using some array antennas without spreading the antenna mast completely. At this time, while the first section 110 may rise by only the minimum distance at which there is no interference with the second array antenna 140 without maximally rising to minimize the height rise of the antenna mast, the first section 110 may measure a signal of a high-band frequency, using the first array antenna 120. Afterward, the second section 130 and the third section may be raised maximally, thereby raising the multi-bay antenna to the maximum height.

Furthermore, when the antenna mast is composed of 'N' sections and 'M' array antennas are mounted on some of the sections in the antenna mast, sections in each of which an array antenna is mounted may rise to the minimum distance where there is no interference between array antennas, and sections in each of which an array antenna is not mounted may be designed to rise to the maximum distance. At this time, 'N' may be an integer and 'M' may be an integer less than 'N'.

Figure 3:
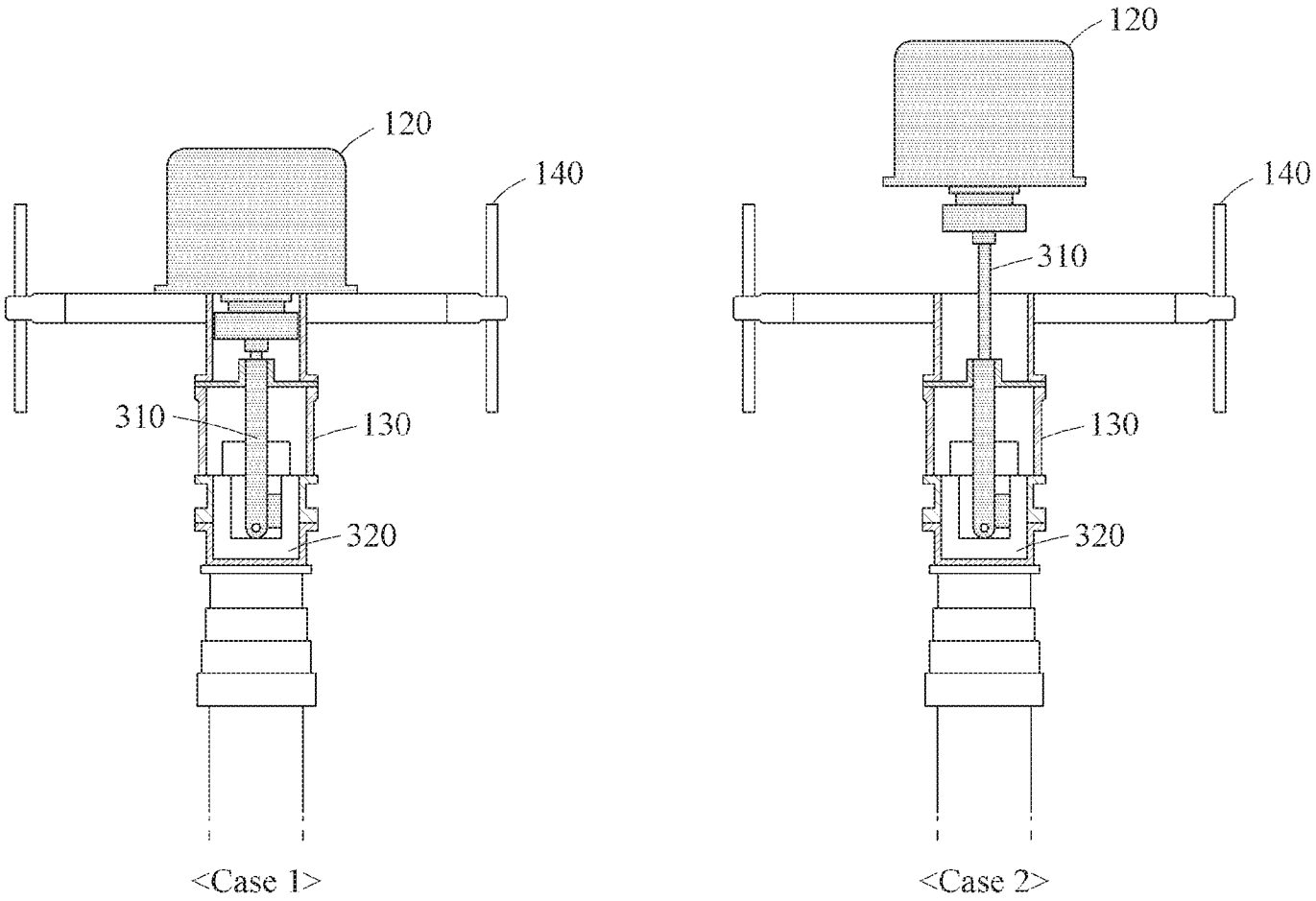
FIG. 3 is a view illustrating an operation of a multi-bay antenna apparatus, according to a second example embodiment of the present invention.

FIG. 3 is a view illustrating an operation of a multi-bay antenna apparatus, according to a second example embodiment of the present invention.

The multi-bay antenna apparatus according to the second example embodiment of the present invention may be a multi-bay antenna apparatus that is automatically stretched depending on a condition using an actuator and a sensor.

As illustrated in FIG. 3, the multi-bay antenna apparatus according to the second example embodiment may include a first section 310, the first array antenna 120, the second section 130, the second array antenna 140, and an actuator 320. At this time, the first section 310, the first array antenna 120, the second section 130, the second array antenna 140 are components the same as the first section 110, the first array antenna 120, the second section 130, the second array antenna 140 of FIG. 1, redundant descriptions will be omitted.

The multi-bay antenna apparatus according to the second example embodiment of the present invention may be coupled with an apparatus, such as a movable vehicle.

Moreover, while the apparatus with which the multi-bay antenna apparatus is coupled is moving, as illustrated in Case 1, the actuator 320 may improve stability by moving the first section 310 to minimize the size of the multi-bay antenna.

Furthermore, when the apparatus, with which the multi-bay antenna apparatus is coupled, is measuring a signal while being stopped or going slowly, as illustrated in Case 2, the actuator 320 may move the first section 310 to increase the interval between the first array antenna 120 and the second array antenna 140, thereby minimizing the interference between a signal received by the first array antenna 120 and a signal received by the second array antenna 140.

At this time, the actuator 320 may be a hydraulic device or may be a motor. Furthermore, the actuator 320 may move the first section 310 depending on the moving speed of the movable apparatus and whether the movable apparatus measured by a sensor (not illustrated) is moved.

In particular, when it is measured by the sensor that the apparatus with which the multi-bay antenna apparatus is coupled moves at a predetermined speed or more, it may be difficult to measure a signal, using a multi-bay antenna. Accordingly, the actuator 320 may move the first section 310 such that the interval between the first array antenna 120 and the second array antenna 140 is minimized.

Also, when it is measured by the sensor that the apparatus with which the multi-bay antenna apparatus is coupled moves at less than the predetermined speed, the movable apparatus may be in a state where a signal is to be measured using the multi-bay antenna apparatus. Accordingly, the actuator 320 may move to a distance at which the signal received by the first array antenna and the signal received by the second array antenna does not interfere with each other, such that the first array antenna and the second array antenna are spaced from each other.

That is, the multi-bay antenna apparatus according to the second example embodiment of the present invention may minimize the interference between array elements to improve reception performance, by minimizing the antenna height when moving to increase stability and by maximizing an antenna height when measuring a signal to extend the interval between antennas for each band.

Figure 4:
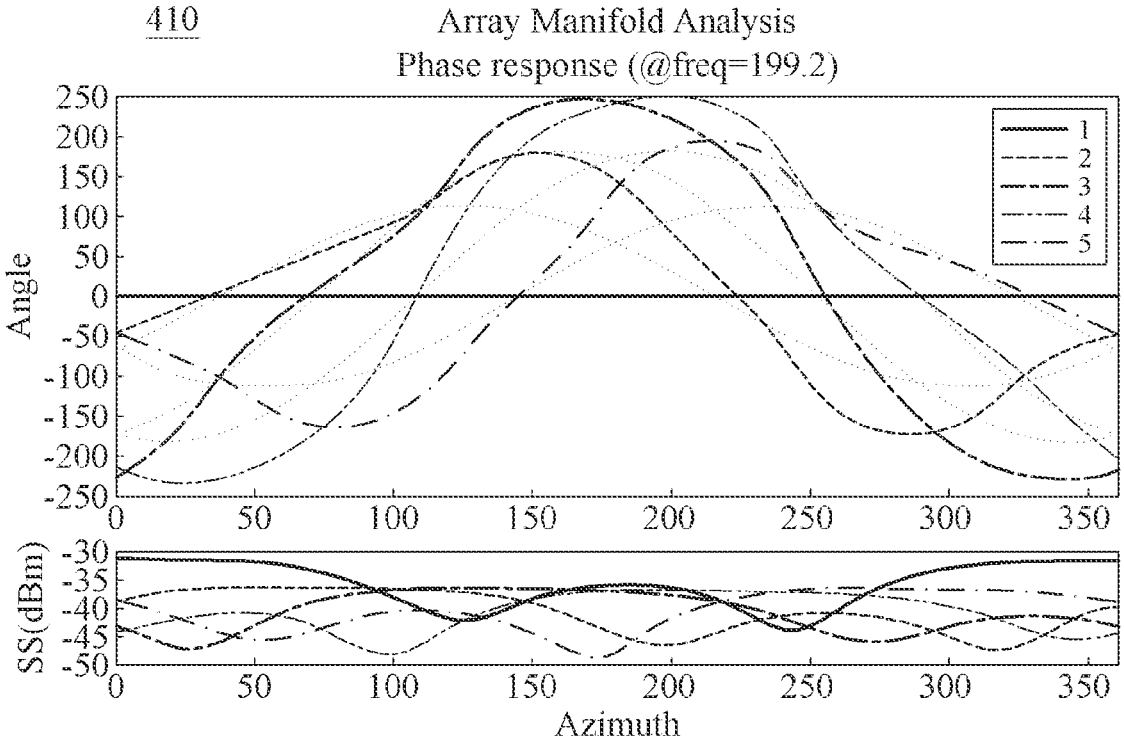
FIG. 4 is an example of an array response characteristic based on an operation of a multi-bay antenna apparatus, according to an example embodiment of the present invention.
Figure 4:
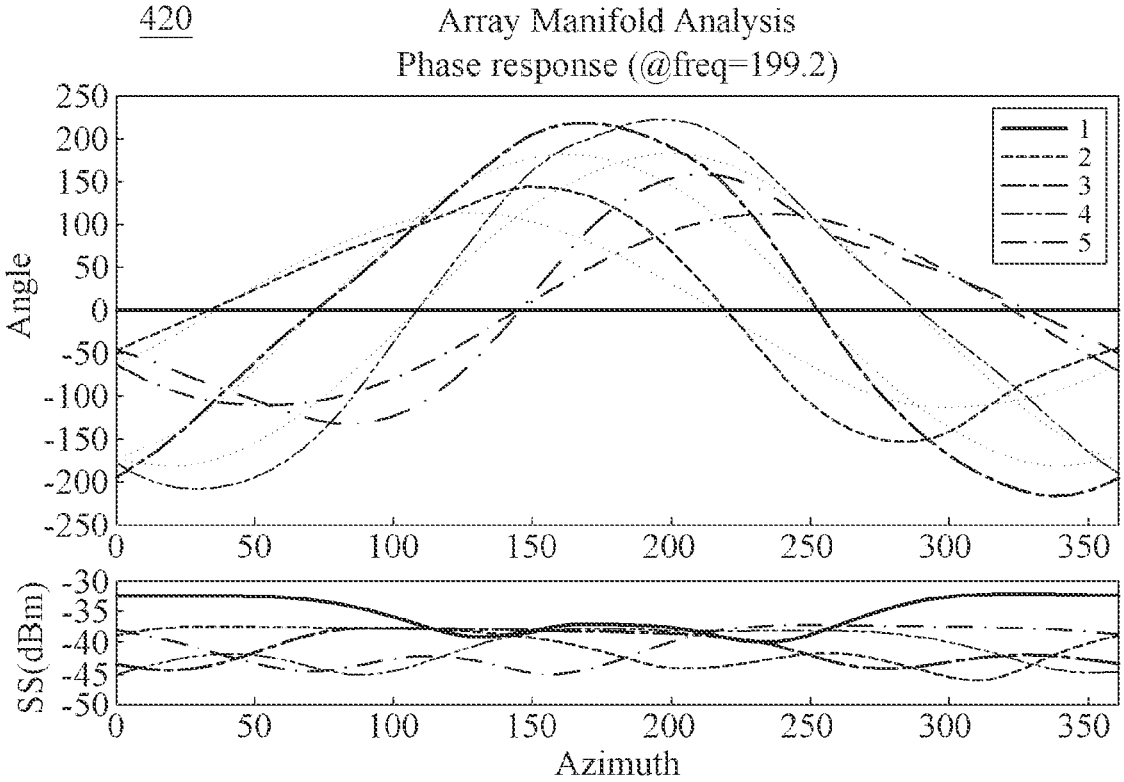

FIG. 4 is an example of an array response characteristic based on an operation of a multi-bay antenna apparatus, according to an example embodiment of the present invention.

Graph 410 of FIG. 4 is a diagram illustrating the changes of a phase and a signal level of the remaining four elements with respect to the first antenna (blue) by rotating the antenna including the mast by 360 degrees in a state where the interval between array antennas is minimized in a multi-bay antenna apparatus in which five array antennas are combined.

Furthermore, graph 420 of FIG. 4 is a diagram illustrating the changes of a phase and a signal level of the remaining four elements with respect to the first antenna by rotating the antenna including the mast by 360 degrees in a state of moving sections such that the interval between array antennas is maximized in a multi-bay antenna apparatus in which five array antennas are combined.

At this time, the dotted line on the top phase graph is the theoretical result, and the solid line is the measurement result.

According to graph 410 and graph 420, as the distance between the low-band and high-band is greater, the phase response of the array response may be less distorted and the level change may not be great in the signal level graph.

Figure 5:
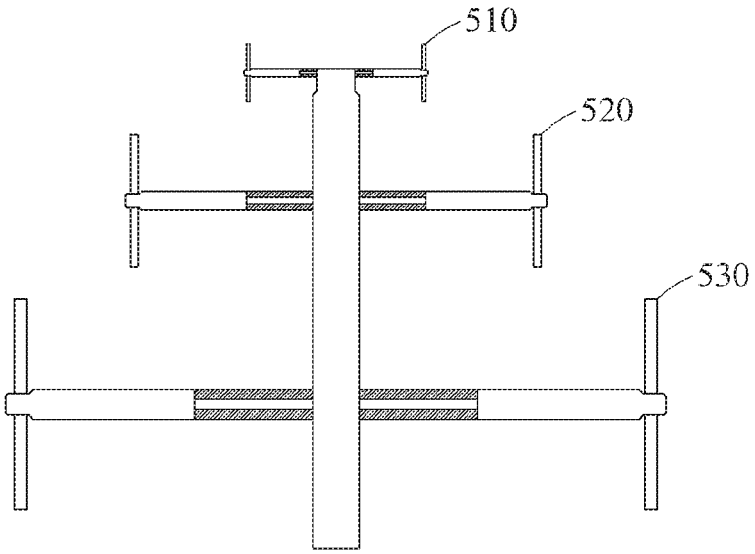
FIG. 5 illustrates a fixed multi-bay antenna apparatus.

FIG. 5 illustrates a fixed multi-bay antenna apparatus.

As illustrated in FIG. 5, the first array antenna 120 may include a first bay 510, a second bay 520, and a third bay 530 and may be a fixed multi-bay antenna in which the interval between bays is fixed.

Figure 6:
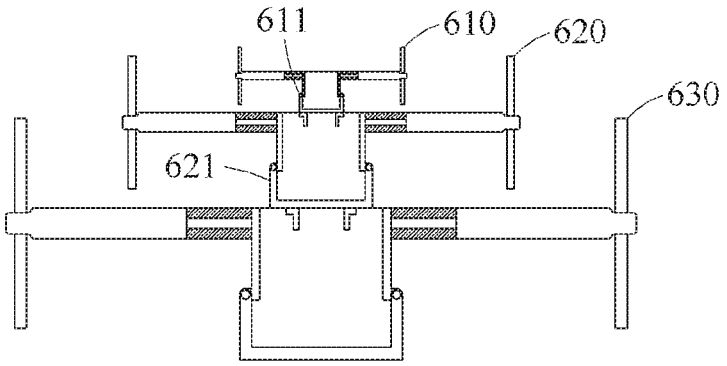
FIG. 6 is a view illustrating an operation of a multi-bay antenna apparatus, according to a third example embodiment of the present invention.
Figure 6:
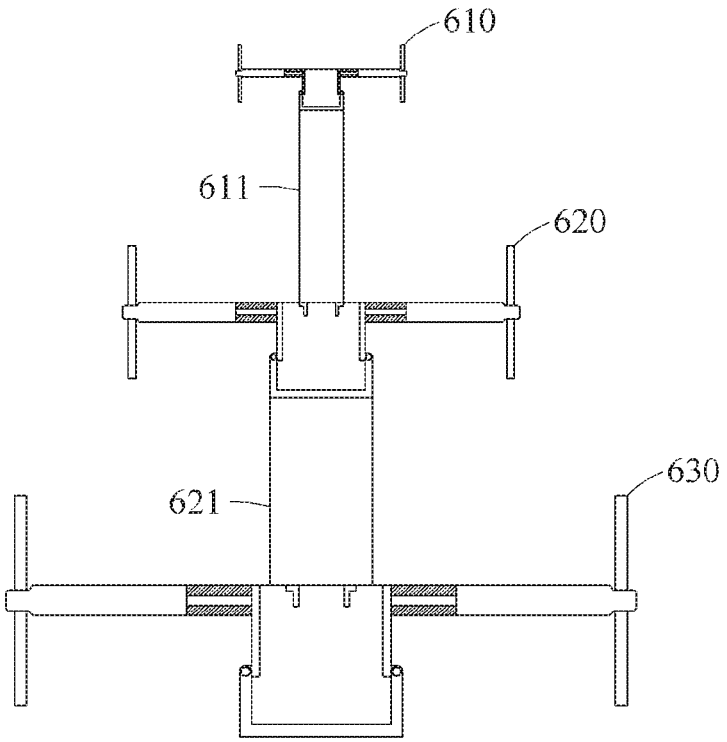

FIG. 6 is a view illustrating an operation of a multi-bay antenna apparatus, according to a third example embodiment of the present invention.

Case 1 of FIG. 6 is in a state in which the height of the multi-bay antenna is minimized by folding a first section 611, in which an array antenna 610 is mounted, and a second section 621 in which a second array antenna 620 is mounted, in a multi-bay antenna including the first array antenna 610, the second array antenna 620, and a third array antenna 630.

Case 2 of FIG. 6 is in a state in which the height of the multi-bay antenna is maximized by unfolding the first section 611, in which the array antenna 610 is mounted, and the second section 621 in which the second array antenna 620 is mounted, in the multi-bay antenna.

Figure 7:
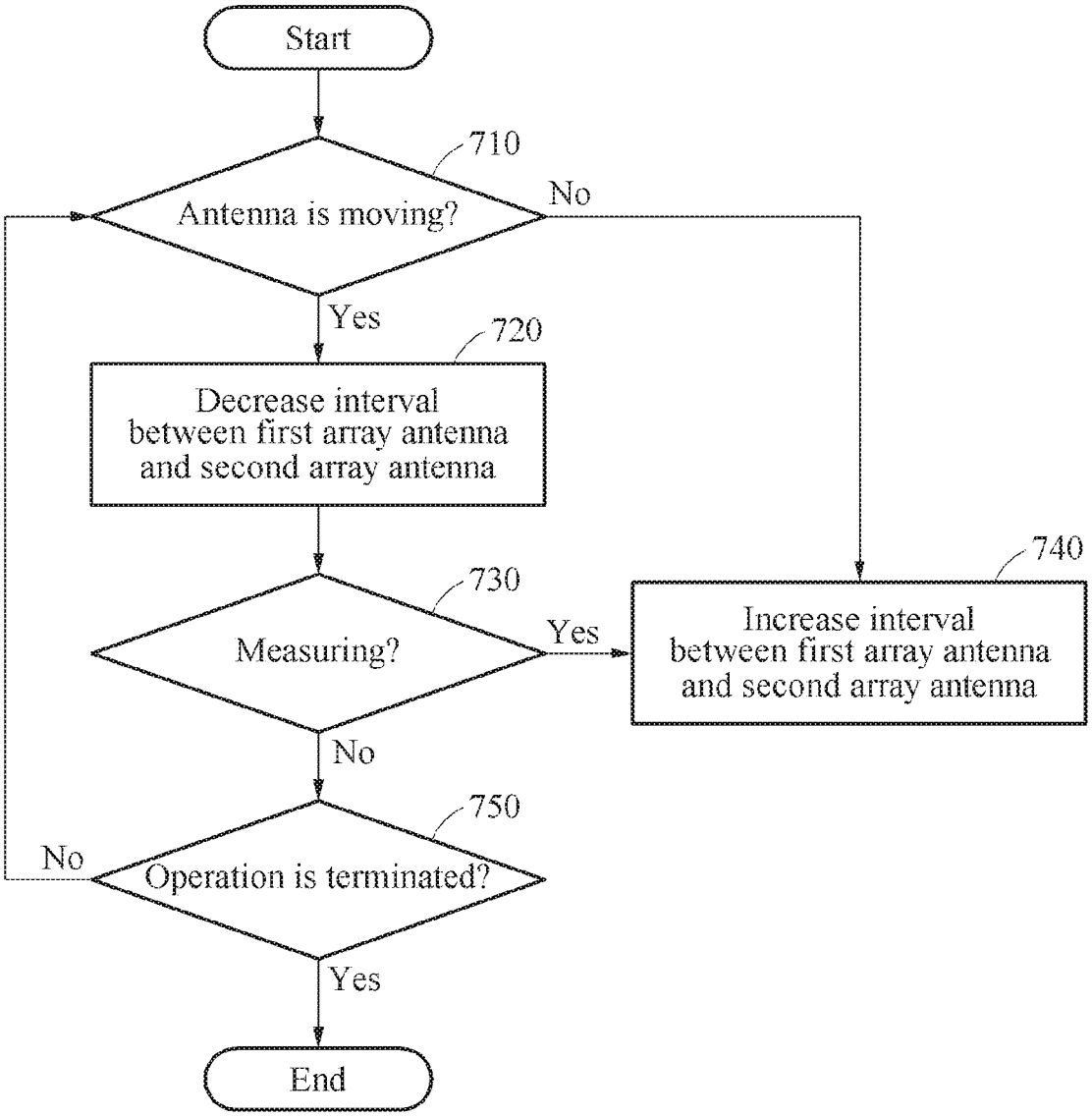
FIG. 7 is a flowchart illustrating an operation method of a multi-bay antenna apparatus, according to an example embodiment of the present invention.

FIG. 7 is a flowchart illustrating an operation method of a multi-bay antenna apparatus, according to an example embodiment of the present invention.

In operation 710, a sensor of a multi-bay antenna apparatus may measure whether a movable apparatus, with which the multi-bay antenna apparatus is coupled, is moved and the moving speed of the movable apparatus. Moreover, the processor of the multi-bay antenna apparatus may determine whether the antenna is moving, based on the moving speed of the apparatus measured by the sensor and whether the apparatus is moved. Moreover, when the antenna is moving at a predetermined speed or more, the processor of the multi-bay antenna apparatus may perform operation 720. Furthermore, when the antenna is not moving or is moving at less than the predetermined speed, the processor of the multi-bay antenna apparatus may perform operation 740.

In operation 720, the actuator 320 may reduce the interval between the first array antenna and the second array antenna at the request of the processor.

In operation 730, the processor of the multi-bay antenna apparatus may determine whether the antenna is measuring a signal, based on the moving speed of the apparatus measured by the sensor and whether the apparatus is moved. At this time, when the apparatus goes slowly such that the moving speed of the apparatus with which the multi-bay antenna apparatus is coupled is less than a predetermined speed or is stopped, the processor of the multi-bay antenna apparatus may perform operation 740 by determining that a signal is being measured. Furthermore, when the moving speed of the apparatus with which the multi-bay antenna apparatus is coupled is maintained at the predetermined speed or more, the processor of the multi-bay antenna apparatus may repeatedly perform operation 710 to operation 730 until the moving speed of the apparatus with which the multi-bay antenna apparatus is coupled is less than the predetermined speed.

In operation 740, the actuator 320 may move the first section 310 to a distance at which the signal received by the first array antenna and the signal received by the second array antenna do not interfere with each other, such that the first array antenna and the second array antenna are spaced from each other, at the request of the processor. At this time, the first array antenna 120 and the second array antenna 140 may receive a signal corresponding to frequency bands, respectively; the processor of the multi-bay antenna apparatus may measure the signal received by each of the first array antenna 120 and the second array antenna 140.

In operation 750, the processor of the multi-bay antenna apparatus may determine whether the operation of the multi-bay antenna apparatus is terminated. At this time, when the power of the multi-bay antenna apparatus is cut off, when the power of the apparatus with which the multi-bay antenna apparatus is coupled is cut off, or when ignition is turned off, the processor of the multi-bay antenna apparatus may terminate an operation by determining that the operation of the multi-bay antenna apparatus is terminated. Moreover, when the operation is not terminated, the processor of the multi-bay antenna apparatus may perform operation 710.

According to an example embodiment of the present invention, it is possible to adaptively control the interval with another array antenna by adding a section in which an array antenna receiving a signal in the corresponding frequency band are coupled with the corresponding array antenna, depending on the number of frequency bands to be received, thereby receiving signals in multiple different frequency bands.

Furthermore, according to an example embodiment of the present invention, it is possible to minimize the interference between array elements to improve reception performance, by minimizing the antenna height when moving to increase stability and by maximizing an antenna height when measuring a signal to extend the interval between antennas for each band.

The components described in the example embodiments may be implemented by hardware components including, for example, at least one digital signal processor (DSP), a processor, a controller, an application-specific integrated circuit (ASIC), a programmable logic element, such as a field programmable gate array (FPGA), other electronic devices, or combinations thereof. At least some of the functions or the processes described in the example embodiments may be implemented by software, and the software may be recorded on a recording medium. The components, the functions, and the processes described in the example embodiments may be implemented by a combination of hardware and software.

In the meantime, a multi-bay antenna apparatus operating method according to an example embodiment of the present invention may be implemented as various recording media such as a magnetic storage medium, an optical read medium, and a digital storage medium after being implemented as a program that can be executed in a computer.

The implementations of the various technologies described in the specification may be implemented with a digital electronic circuit, computer hardware, firmware, software, or the combinations thereof. The implementations may be achieved as a computer program product, for example, a computer program tangibly embodied in a machine readable storage device (a computer-readable medium) to process the operations of a data processing device, for example, a programmable processor, a computer, or a plurality of computers or to control the operations. The computer programs such as the above-described computer program(s) may be recorded in any form of a programming language including compiled or interpreted languages, and may be executed as a standalone program or in any form included as another unit suitable to be used in a module, component, sub routine, or a computing environment. The computer program may be executed to be processed on a single computer or a plurality of computers at one site or to be distributed across a plurality of sites and then interconnected by a communication network.

The processors suitable to process a computer program include, for example, both general purpose and special purpose microprocessors, and any one or more processors of a digital computer of any kind. Generally, the processor may receive instructions and data from a read only memory, a random access memory or both of a read only memory and a random access memory. The elements of a computer may include at least one processor executing instructions and one or more memory devices storing instructions and data. In general, a computer may include one or more mass storage devices storing data, such as a magnetic disk, a magneto-optical disc, or an optical disc or may be coupled with them so as to receive data from them, to transmit data to them, or to exchange data with them. For example, information carriers suitable to embody computer program instructions and data include semiconductor memory devices, for example, magnetic Media such as hard disks, floppy disks, and magnetic tapes, optical Media such as compact disc read only memory (CD-ROM), and digital video disc (DVD), magneto-optical media such as floppy disks, ROM, random access memory (RAM), flash memory, erasable programmable ROM (EPROM), electrically erasable programmable ROM (EEPROM), and the like. The processor and the memory may be supplemented by a special purpose logic circuit or may be included by the special purpose logic circuit.

Furthermore, the computer-readable medium may be any available medium capable of being accessed by a computer and may include a computer storage medium.

Although the specification includes the details of a plurality of specific implementations, it should not be understood that they are restricted with respect to the scope of any invention or claimable matter. On the contrary, they should be understood as the description about features that may be specific to the specific example embodiment of a specific invention. Specific features that are described in this specification in the context of respective example embodiments may be implemented by being combined in a single example embodiment. On the other hand, the various features described in the context of the single example embodiment may also be implemented in a plurality of example embodiments, individually or in any suitable sub-combination. Furthermore, the features operate in a specific combination and may be described as being claimed. However, one or more features from the claimed combination may be excluded from the combination in some cases. The claimed combination may be changed to sub-combinations or the modifications of sub-combinations.

Likewise, the operations in the drawings are described in a specific order. However, it should not be understood that such operations need to be performed in the specific order or sequential order illustrated to obtain desirable results or that all illustrated operations need to be performed. In specific cases, multitasking and parallel processing may be advantageous. Moreover, the separation of the various device components of the above-described example embodiments should not be understood as requiring such the separation in all example embodiments, and it should be understood that the described program components and devices may generally be integrated together into a single software product or may be packaged into multiple software products.

In the meantime, example embodiments of the present invention disclosed in the specification and drawings are simply the presented specific example to help understand an example embodiment of the present invention and not intended to limit the scopes of example embodiments of the present invention. It is obvious to those skilled in the art that other modifications based on the technical idea of the present invention may be performed in addition to the example embodiments disclosed herein.

What is claimed is:

1. A multi-bay antenna apparatus comprising:

a first section;

a first array antenna mounted in the first section to receive a signal in a predetermined frequency band;

a second section movably coupled with the first section; and a second array antenna mounted in the second section to receive a signal in a predetermined frequency band, wherein the movably coupling of the second section and the first section is along a common centerline of the first section and the second section, and wherein the first section moves to a distance where a signal received by the first array antenna and a signal received by the second array antenna do not interfere with each other such that the first array antenna and the second array antenna are spaced.

2. The multi-bay antenna apparatus of claim 1, wherein the second array antenna and the first array antenna receive signals in different frequency bands from each other.

3. The multi-bay antenna apparatus of claim 1, wherein the second array antenna and the first array antenna receive signals in the same frequency band as each other, and wherein the first section moves to a location to allow the first array antenna and the second array antenna to be arranged to be spatially distributed to increase an interval between the first array antenna and the second array antenna.

4. The multi-bay antenna apparatus of claim 1, further comprising:

a third section, the second section movably coupled with the third section; and a third array antenna mounted in the third section to receive a signal in a predetermined frequency band.

5. The multi-bay antenna apparatus of claim 4, wherein the second section moves such that an interval between the second array antenna and the third array antenna is spaced, after the first section moves to a predetermined distance.

6. A multi-bay antenna apparatus coupled with a movable apparatus, the multi-bay antenna apparatus comprising:

a first section;

a first array antenna mounted in the first section to receive a signal in a predetermined frequency band;

a second array antenna to receive a signal in a predetermined frequency band;

a second section, the second section internally coupled with the first section and externally coupled with the second array antenna;

an actuator to move the first section; and a sensor to measure whether the movable apparatus is moved and a moving speed of the movable apparatus, wherein the moving of the first section is along a common centerline of the first section and the second section, and wherein the actuator moves the first section to a distance where a signal received by the first array antenna and a signal received by the second array antenna do not interfere with each other such that the first array antenna and the second array antenna are spaced, when it is measured by the sensor that the movable apparatus is moving at less than a predetermined speed.

7. The multi-bay antenna apparatus of claim 6, wherein the actuator moves the first section such that an interval between the first array antenna and the second array antenna is minimized, when it is measured by the sensor that the movable apparatus is moving at a predetermined speed or more.

* * * * *